US005086418A

United States Patent [19]

Marcus

[11] Patent Number: 5,086,418

[45] Date of Patent: Feb. 4, 1992

[54] LUMINESCENT FEATURED WATCH

[76] Inventor: Mark W. Marcus, 20671 De La Guerra, Woodland Hills, Calif. 91364

[21] Appl. No.: 676,856

[22] Filed: Mar. 28, 1991

[51] Int. Cl.[5] ..... G04B 19/32; G04B 37/00

[52] U.S. Cl. ..... 368/226; 368/280; 368/282; 224/167

[58] Field of Search ..... 368/226, 276, 280–282; 224/167, 178

[56] References Cited

U.S. PATENT DOCUMENTS 2,629,981 3/1953 Melik-Minassiantz ..... 368/281

3,851,460 12/1974 Hquerez ..... 368/226

4,130,987 12/1978 Schickendanz ..... 368/282

*Primary Examiner*—Vit W. Miska

*Attorney, Agent, or Firm*—Roy A. Ekstrand

[57] ABSTRACT

A luminescent featured watch includes a molded plastic case and watchband formed of a luminescent material. A plurality of luminescent and nonluminescent opaque design elements are supported upon the luminescent portions of the watch to provide a change in appearance of the watch between high ambient light and darkened light conditions. The luminescent materials of the watch cause the watch to glow in a darkened environment.

8 Claims, 2 Drawing Sheets

LUMINESCENT FEATURED WATCH

CROSS REFERENCE TO RELATED PATENT APPLICATION

This application discloses apparatus described and claimed in a related copending patent application entitled Luminescent Material and Process having a Ser. No. 676,857 and filed Mar. 28, 1991 by the applicant of the present application.

FIELD OF THE INVENTION

This invention relates generally to watches or similar articles and particularly to improvements thereof directed toward enhancing their interest and amusement value.

BACKGROUND OF THE INVENTION

Perhaps no article of human use has seen a greater variety of design and appearances than the pervasive watch. Virtually all adult humans and many children are found wearing some type of watch upon their forearm or watch as they go about their daily lives. While the variation in appearance and design of such watches varies dramatically with taste preference, all generally include a case or housing within which the working apparatus of the watch is supported and protected. A dial or other time indicating mechanism is generally supported upon the outer face of the watch case and is protected by an overlying clear crystal or the like. In general, some type of band or other similar fastening article is secured to the watch case and is used to attach the watch to the wearer's wrist or forearm. Certain watches are fabricated in a form known as a pocket watch in which the case supports the internal works and in which a dial and time indication mechanism is protected by a clear crystal. In pocket watch type timepieces, the band is generally omitted and unnecessary.

Not long after the development of reliable watches of the type which may be worn upon the wrist or carried easily in a pocket, practitioners in the art soon found that mere function was usually insufficient to effectively market their watches. The trend which quickly developed and continues to this day found users demanding evermore decorative and interesting appearing watches to suit a variety of user tastes.

Practitioners have attempted to provide more interesting and decorative watches by resorting to the use of various types of metals including brilliant and often precious metals, inlays of jewels and stones, and the more recently developed colorful plastic molded cases and bands.

U.S. Pat. No. 4,910,532 issued to Rhine sets forth a COMBINATION WRIST WATCH AND FLASHLIGHT in which an analog watch for training children to read the time includes a watch case supporting a flashlight. The flashlight is configured to illuminate the watch face and permit the reading of the indicated time in low light or darkness. The flashlight includes a mechanism for automatically turning off the flashlight after a predetermined period of illumination.

While the foregoing described prior art types of watches have provided improvement and enhancements to the decorative qualities and interest values of watches generally, there remains a continuing need in the art for evermore interesting and exciting types of watches.

SUMMARY OF THE INVENTION

Accordingly, it is a general object of the present invention to provide an improved more interesting watch. It is a more particular object of the present invention to provide an improved more interesting watch which responds to the presence or absence of high ambient light or darkness. It is a still more particular object of the present invention to provide a more interesting appearing watch which changes appearance between daylight and darkness environments.

In accordance with the present invention, there is provided a luminescent featured watch comprises: a case formed of a luminescent material for supporting a time-piece mechanism; a watchband joined to the case and formed of a luminescent material; and a time indicia bearing face supported by the case.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
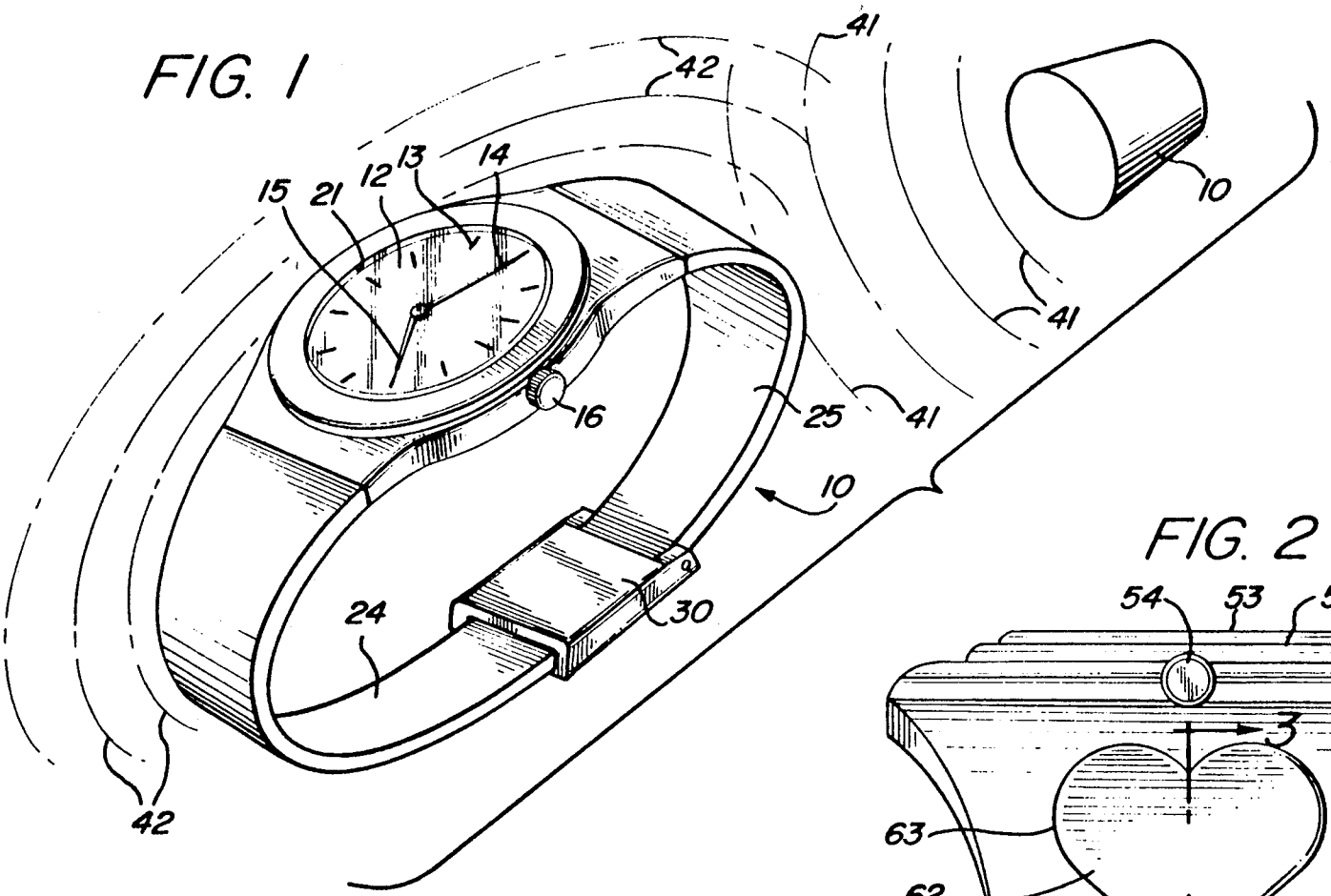
FIG. 1 sets forth a perspective view of a luminescent featured watch constructed in accordance with the present invention.

FIG. 1 sets forth a perspective view of a luminescent featured watch constructed in accordance with the present invention and generally referenced by numeral 10. Watch 10 includes a case 11 defining a recess 20 which receives conventional timepiece works (not shown) in a standard method of fabrication. A dial face 12 having a generally planar configuration supports a plurality of time indicia marks 13 spaced about dial face 12 within recess 20. A pair of time indicating hands 14 and 15 are coupled to the timepiece works within recess 20 of case 11 in accordance with conventional fabrication techniques. A stem coupling 16 is coupled to the timepiece works of watch 10 within recess 20 in accordance with conventional fabrication techniques. A transparent crystal 21 is received within recess 20 and secured to case 11 in a secure watertight attachment. Case 11 further defines a pair of hinge couplers 22 and 23. A pair of watchband segments 24 and 25 are coupled to case 11 at hinges 22 and 23 respectively. The remaining ends of band segments 24 and 25 are mutually coupled to complete the wrist encirclement of watch 10 by a conventional clasp 30.

In accordance with the present invention, a light source 40, which may be an artificial light source or natural daylight, produces an illuminating source of incident light energy 41 which radiates watch 10. In accordance with an important aspect of the present invention, case 11 and watchband segments 24 and 25 are formed of a luminescent or glow in the dark material characterized by its capability to store energy from illuminating light sources and reradiate light energy in a long duration glow. Accordingly, incident light 41, illuminating case 11 and band segments 24 and 25 causes the luminescent materials therein to absorb light energy. Once light source 40 is removed and watch 10 is place in a darkened or reduced light environment, the stored light energy within the luminescent material of case 11 and band segments 24 and 25 produces an outwardly radiating glow light energy indicated by light waves 42. In accordance with the characteristic of luminescent materials, a relatively brief exposure to light source 40 results in energizing the luminescent material of watch 10 to radiate glow light energy 42 for an extended period of time.

In the embodiment shown in FIG. 1, case 11 and band segments 24 and 25 may be provided with their luminescent characteristics using a number of luminescent materials. However, it has been found particularly advantageous to fabricate case 11 and band segments 24 and 25 in accordance with the luminescent material and process set forth in the above-identified related patent application.

Thus, as is set forth therein, case 11 and watchband segments 24 and 25 are fabricated of a molded plastic material in accordance with the following process.

Initially, a zinc sulfide compound is formed by conventional processes. It should be noted that zinc sulfide may be formed in a non-radioactive luminescent material. The zinc sulfide material formed is thereafter ground in a grounding step to a uniform powdered consistency. The powder consistency or coarseness of zinc sulfide powder thus formed is selected to maintain the desired crystal structure necessary for the luminescent characteristic of the zinc sulfide material.

Thereafter, a quantity of finely ground copper metal is added to the powdered zinc sulfide. While the quantity of powdered copper metal to be added is subject to some variation, it has been found that a mixture of copper powder of approximately five percent (5%) of the total dry mixture of zinc sulfide and powdered copper performs well under most manufacturing processes. Thereafter, a dry mixing process is carried forward to uniformly mix the zinc sulfide powder and copper metal powder to a uniform consistent solid mixture. The resulting solid mixture is then combined with a conventional granulated polyvinylchloride plastic material. Next, the granulated polyvinylchloride material is formed in accordance with the molding process to be employed in forming the molded article. In its preferred form, the polyvinylchloride material is granulated in accordance with the coarseness and granule size appropriate to injection molding fabrication techniques.

Once the granulated polyvinylchloride has been added, a second dry mixing step is performed in which the granulated polyvinylchloride and combined zinc sulfide and copper mixture are uniformly mixed to a solid mixture. Once the dry mixing is complete, the resulting mixture is heated to the flow temperature of the mixture. It should be noted that care must be taken during heating to avoid breaking down the crystal structure of the zinc sulfide and copper mixture. It has been found that temperatures of seven hundred and fifty degrees Fahrenheit may be used without breaking down the crystal structure of the zinc sulfide and copper mixture. Once the mixture has been heated to a uniform flow temperature, a conventional injection molding process is carried forward to form a luminescent polyvinyl chloride molded plastic unit.

Thus, in accordance with the invention, the use of luminescent materials for case 11 and band segments 24 and 25 provide watch 10 with a novel characteristic which greatly increases the amusement and interest value of watch 10. In addition to the fabrication of case 11 and band segments 24 and 25 of watch 10 of a luminescent material, additional interests and amusement value may be further added by combining the luminescent watch case and band segments of watch 10 with additional layers of luminescent and nonluminescent materials. FIGS. 2 through 7 set forth below show examples of the use of such additional materials to further enhance the amusement and entertainment value of watch 10.

Figure 2:
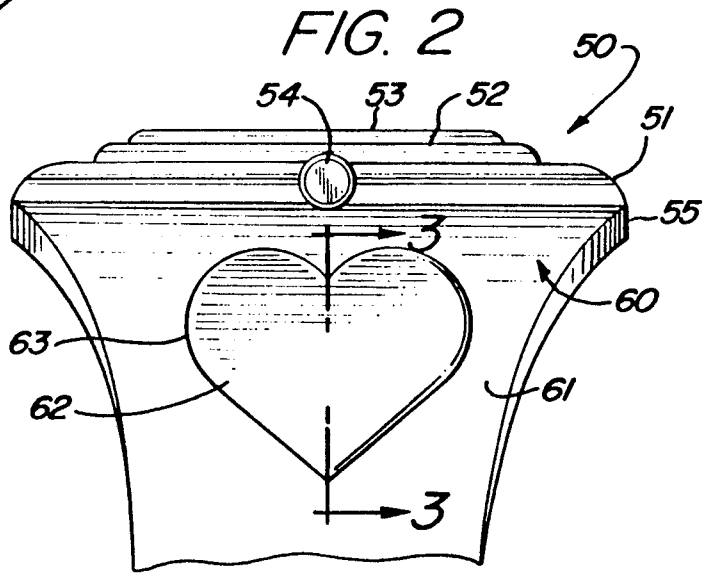
FIG. 2 sets forth a partial section view of an alternate embodiment of the present invention luminescent featured watch.

With specific reference to FIG. 2, a luminescent featured watch generally referenced by numeral 50 is constructed in a similar manner to watch 10 set forth above. Accordingly, watch 50 includes a watch case 51 which supports internal timepiece works (not shown) constructed in accordance with conventional fabrication techniques. Case 51 defines a recess 52 supporting a crystal 53 and a coupling stem 54 is secured to case 51 and coupled to the internal timepiece works of watch 50 (not shown). A watchband segment 60 is coupled to case 51 by a hinge 55. A similar watchband segment is secured to the opposite side of case 51 in accordance with the construction of watch 10 set forth above in FIG. 1 which is not seen in FIG. 2. Watchband segment 60 defines an outer surface 61 extending downwardly from hinge 55. An opaque material layer 62 is deposited upon outer surface 61 and defines an outer edge 63. Opaque material layer 62 and edge 63 are generally configured in a heart-shaped design for purposes of illustration. It will be apparent to those skilled in the art, however, that any number of material layer shapes may be substituted for the heart shape of material layer 62 without departing from the spirit and scope of the present invention.

In accordance with the invention, case 51 and watchband segment 60 are formed of a luminescent material which in its preferred form comprises a molded plastic material such as polyvinylchloride fabricated in accordance with the above-referenced copending related application. Thus, band segment 60 and case 51 are formed of luminescent materials and thus radiate a luminescent glow in the manner described above for watch 10 in FIG. 1. Opaque material layer 62, however, is in the embodiment of FIG. 2 formed of a nonluminescent opaque material. Accordingly, when watch 50 is placed within a reduced light or darkened environment after having been energized by a light source, case 51 and band segment 60 function in accordance with the luminescent properties which they possess to provide a luminiscent glow of light which emanates from the entirety of case 51 and band segment 60 with the exception of the portion of outer surface 61 of band surface 60 which is covered by opaque material layer 62. The opaque properties of material layer 62 inhibit or absorb the luminescent energy emanating from outer surface 61. Accordingly, as watch 50 glows in the reduced light or darkened environment situations, a darkened area lacking any luminescent glow corresponding to opaque material layer 62 appears on outer surface 61 of watch 50. Thus, as the case and band segments of watch 50 glow in a darkened environment, the area of material layer 60 appears as a dark design upon band segment 60.

In accordance with the embodiment of the present invention shown in FIG. 2, several interesting variations or themes present themselves. For example, if band segment 60 is formed of a molded plastic luminescent material which is significantly darker than the color of opaque material layer 62, the appearance of watch 50 will undergo a reversal of the appearance relationship between the design of material layer 62 and band segment 60. In other words, under normal lighting circumstances, band segment 60 will be darker than material layer 62 while in a darkened environment, the luminescent glow of band segment 60 and the opaque characteristics of material layer 62 will combine to reverse this relationship causing material layer 62 to be darker and band segment 60 to be lighter.

By way of further example, in the event the colors of band segment 60 and opaque material layer 62 are selected to achieve a color match, the design of material layer 62 will be generally invisible or undetectable under normal lighting conditions. Under darkened or reduced lighting conditions, however, the luminescent characteristic of band segment 60 will cause the design of opaque material layer 62 to emerge and be seen only when watch 50 is used in a darkened environment.

Figure 3:
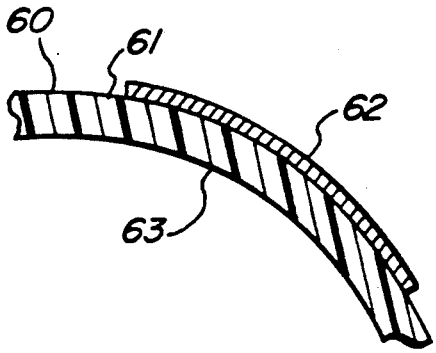
FIG. 3 sets forth a partial section view of the present invention luminescent featured watch taken along section lines 3—3 in FIG. 2.

FIG. 3 sets forth a section view of watch 50 taken along section lines 3—3. As mentioned above, band segment 60 is preferably formed of a molded plastic luminescent material and defines an outer surface 61. Opaque material layer 62 is formed upon outer surface 61 in accordance with conventional fabrication techniques such as silk-screening processes or other coating techniques. It will be apparent to those skilled in the art that while opaque material layer 62 is shown on outer surface 61 of band segment 60, it may alternatively be formed upon inner surface 63 of band segment 60 without departing from the spirit and scope of the present invention.

Figure 4:
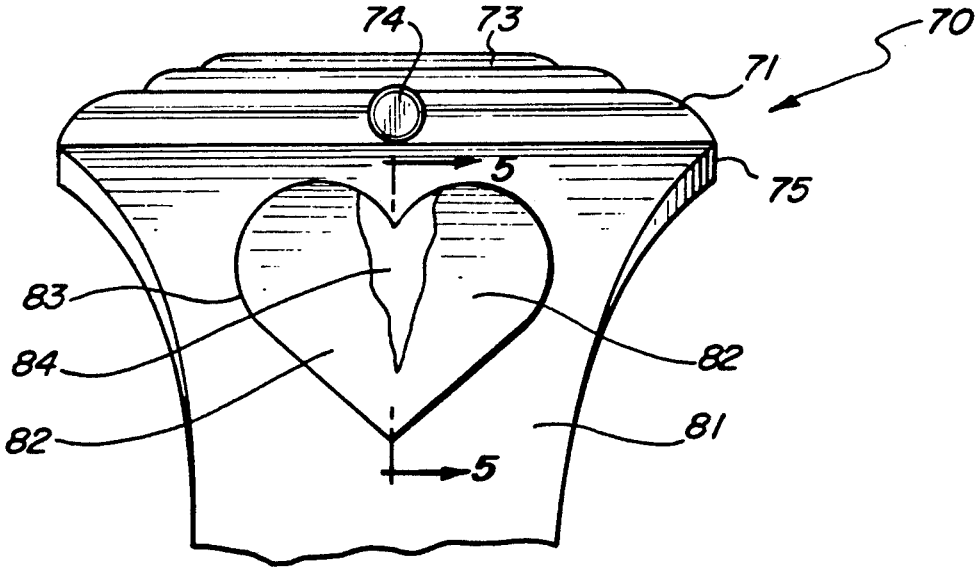
FIG. 4 sets forth a partially sectioned view of an alternate embodiment of the present invention luminescent featured watch.
Figure 5:
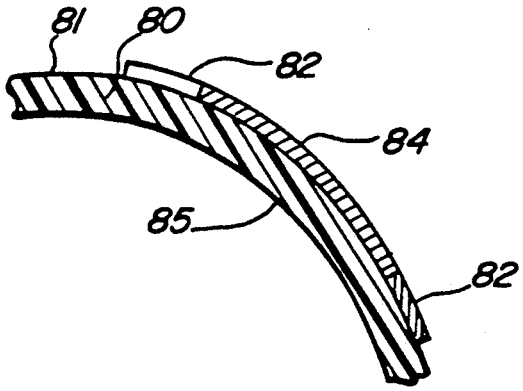
FIG. 5 sets forth a section view of the present invention luminescent featured watch taken along section lines 5—5 in FIG. 4.

FIGS. 4 and 5 set forth a still further alternate embodiment of the present invention luminescent featured watch generally referenced by numeral 70. With specific reference to FIG. 4, watch 70 includes a case 71 defining a recess 72 and supporting a transparent crystal 73. An internal timepiece works (not shown) constructed in accordance with conventional fabrication techniques is coupled to a stem 74 in a conventional manner. A watchband segment 80 is coupled to case 71 by a hinge 75. Band segment 80 further defines an outer surface 81 which supports a luminescent material layer 82 defining an outer edge 83. A layer of opaque nonluminescent material 84 is formed upon outer surface 81 and is integrally formed with luminescent material layer 82.

In accordance with the present invention, case 71 and band segment 80 of watch 70 are formed of a molded plastic luminescent material in the manner described above of watches 50 and 10. In addition, luminescent material layer 82 is formed upon outer surface 81 of band segment 80 and defines an outer edge 83 forming a general heart shape. It will be apparent to those skilled in the art that luminescent material layer 82 may be formed into any number of different designs and shapes without departing from the spirit and scope of the present invention. Opaque material layer 84 is formed of a nonluminescent material and, for purposes of illustration, is integral with luminescent material and is intended to replicate the popular "broken heart" design popular in certain graphic and other artistic materials.

In its preferred form, band segment 80 and luminescent material layer 82 are fabricated such that luminescent glow light energy having different colors or wavelengths is produced thereby. In addition to further enhance the interest value of watch 70, opaque nonluminescent material layer 84 is selected to color match the appearance of luminescent material layer 82 under normal ambient light conditions.

Thus, when watch 70 is viewed under normal ambient light, outer surface 81 of band segment 80 is seen supporting a heart-shaped colored area encircled by edge 83. Under low ambient light or darkened conditions, band segment 80 and luminescent material layer 82 produce different color luminescent energies and thus are clearly distinguishable as glowing in two different colors. Opaque nonluminescent material layer 84, however, is seen under such darkened conditions as a darkened area and thus the appearance of the heart-shaped design on outer surface 81 appears to have broken. Thus, the appearance of watch 70 undergoes an interesting and amusing transition due to the cooperative effects of the luminescent material of band segment 80, the luminescent material of layer 82 and the nonluminescent opaque material of layer 84. It will be apparent to those skilled in the art that the "broken heart" example of FIG. 4 is merely intended to demonstrate the interesting capabilities of combining additional luminescent and nonluminescent layers in a creative design upon the present invention watch formed of a luminescent molded plastic material.

FIG. 5 sets forth a section view of watch 70 taken along section lines 5—5 in FIG. 4. As is set forth above, band segment 80 of watch 70 is preferably formed of a molded plastic material having a luminescent property and defining an outer surface 81 and an inner surface 85. Luminescent material layer 82 is formed upon outer surface 81 and partially surrounds an opaque material layer 84.

It will be apparent to those killed in the art that luminescent material layer 82 may be formed using any process available for forming a coating of luminescent material. However, it is believed advantageous to utilize the luminescent material coating process set forth the in the above-referenced related patent application. Thus, in its preferred form, luminescent material layer 82 is formed upon outer surface 81 of band segment 80 by the following process:

Initially, a quantity of zinc sulfide is formed in accordance with conventional fabrication techniques. Thereafter the zinc sulfide material formed is ground to a powder form in a grinding step. The coarseness of powder formed during grinding is, to some extent, a matter of design choice for different uses and processes. However, in its preferred form, the ground zinc sulfide powder formed during grinding is generally uniform in grain size.

Following the grinding step, finely ground copper metal is added to the powdered zinc sulfide. Thereafter, dry mixing is carried forward in which the combined zinc sulfide powder and copper powder are mixed to a solid mixture.

Next, a carrier material or vehicle material is added to the combined zinc sulfide and copper metal powder. A variety of carrier materials may be used, however it has been found that the use of a clear carrier known as NAC-DAR commercially manufactured and sold by DuPont Corporation provides the desired coating compound. While the proportionate part of the zinc sulfide and copper to be added is subject to some design variation, it has been found that a mixture of approximately three and a half pounds of zinc sulfide and copper mixture to each gallon of clear carrier provides the desired result.

Thereafter, the carrier and zinc sulfide and copper metal are mixed to suspend the zinc sulfide and copper within the carrier in a uniform suspension. Once a uniform suspension has been obtained, a coating layer is formed upon the desired medium. While different coating processes may be used, it has been found advantageous to use a silk-screen type process in which a somewhat coarse silk screen having between sixty and eighty count mesh density is used. Once the desired layer is formed, low temperature drying process is carried out to cure the deposited layer. Once again it should be noted that care is taken to avoid excessive temperatures in the drying process which would otherwise breakdown the crystal structure of the zinc sulfide and copper material.

It sill be apparent to those skilled in the art that a variety of combinations of luminescent materials and colors in combination with opaque nonluminescent materials may be coated upon the outer surfaces of the luminescent band segments or other areas of the present invention luminescent featured watch to achieve a virtually endless variety of designs and effects. The important aspect of such designs and effects is the provision of a novel and exciting featured watch which undergoes dramatic appearance changes between high ambient light or dark or darkened ambient light conditions.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A luminescent featured watch comprising:
a case formed of a luminescent material for supporting a time-piece mechanism;
a watchband joined to said case and formed of a luminescent material; and
a time indicia bearing face supported by said case.

2. A luminescent featured watch as set forth in claim 1 wherein said watchband defines a surface and wherein said watch further includes a layer of luminescent material forming a first design element on said surface.

3. A luminescent featured watch as set forth in claim 2 wherein said watchband surface and said layer of luminescent material appear to be generally different colors under lighted conditions and luminescently glow in different colors.

4. A luminescent featured watch as set forth in claim 3 further including a layer of opaque nonluminescent material formed on said surface of said watchband forming a second design element.

5. A luminescent featured watch as set forth in claim 4 wherein said layer of opaque nonluminescent material and said layer of luminescent material are generally similar in color under lighted ambient conditions.

6. A luminescent featured watch as set forth in claim 1 further including a layer of opaque nonluminescent material supported upon said watchband and forming a first design shape, said watchband and said layer of opaque nonluminescent material having similar colors under lighted ambient conditions.

7. A watch comprising:
a watchcase formed of a luminescent molded plastic material; and
a watchband formed of a luminescent molded plastic material coupled to said watchcase,
said luminescent watchcase and watchband cooperating to alter the appearance of said watch between lighted ambient and darkened ambient light conditions.

8. A watch as set forth in claim 7 further including a plurality of design element layers formed on said watchcase and said watchband each having a luminescence different from that of said watchcase and said watchband.

* * * * *